US012637862B2

(12) United States Patent
Ben David et al.

(10) Patent No.: US 12,637,862 B2
(45) Date of Patent: May 26, 2026

(54) POLYCARBONATE ROOF PANEL HAVING REINFORCEMENT RECESS FOR COUPLING TO SANDWICH PANEL

(71) Applicant: DAN-PAL, Kibbutz Dan (IL)

(72) Inventors: Micha Ben David, Upper Galil (IL); Ilan Katan, Karkom (IL)

(73) Assignee: DAN-PAL, Kibbutz Dan (IL)

( * ) Notice: Subject to any disclaimer, the term of this patent is extended or adjusted under 35 U.S.C. 154(b) by 264 days.

(21) Appl. No.: 18/360,046

(22) Filed: Jul. 27, 2023

(65) Prior Publication Data

US 2023/0366206 A1 Nov. 16, 2023

Related U.S. Application Data

(63) Continuation of application No. PCT/IL2021/051374, filed on Nov. 17, 2021.

(30) Foreign Application Priority Data

Jan. 27, 2021 (IL) ..... 280461

(51) Int. Cl.
*E04D 3/362* (2006.01)
*E04D 3/28* (2006.01)
*E04D 3/365* (2006.01)

(52) U.S. Cl.
CPC ..... *E04D 3/362* (2013.01); *E04D 3/365* (2013.01); *E04D 2003/285* (2013.01)

(58) Field of Classification Search
CPC ... E04D 2003/285; E04D 3/361; E04D 3/365; E04D 3/362
See application file for complete search history.

(56) References Cited

U.S. PATENT DOCUMENTS 4,573,300 A * 3/1986 Bezner ..... E04C 2/543 428/116
4,790,112 A 12/1988 Wang
(Continued)

FOREIGN PATENT DOCUMENTS

DE 10208687 A1 9/2003
EP 3290613 A1 3/2018
(Continued)

OTHER PUBLICATIONS

European Patent Office, International Search Report in International Patent Application No. PCT/IL2021/051374, 4 pp. (Feb. 3, 2022).
(Continued)

*Primary Examiner* — Andrew J Triggs
(74) *Attorney, Agent, or Firm* — Leydig, Voit & Mayer Ltd.

(57) ABSTRACT

An industrial roof panel includes a projection and a complementary wing at opposite sides. The projection has a recess configured for clamping the panel to a second neighboring panel using a fastener such that the panel is supported by the second neighboring panel for reduced buckling under downward load. A modular panel system includes first and second mutually juxtaposed panels, each supported by purlins of a building structure extending along a width of the panels. The second panel has an undercut extending along a length of the panel on a distal side thereof. The first panel has an integral wing-type female coupler extending along a length of the first panel and overlaying an upward projection of the second panel, to which it is secured using fasteners and bolts.

11 Claims, 4 Drawing Sheets

(56) References Cited

U.S. PATENT DOCUMENTS

| | | | | |
|---|---|---|---|---|
| 5,966,888 | A | 10/1999 | Richardson | |
| 6,792,730 | B2 * | 9/2004 | Richardson | E04D 3/28 52/461 |
| 6,931,796 | B2 * | 8/2005 | Adriaansen | E04C 2/543 52/537 |
| 7,104,020 | B1 * | 9/2006 | Suttle | E04D 3/362 52/592.1 |
| 8,074,418 | B2 | 12/2011 | Thiagarajan et al. | |
| 9,010,056 | B2 * | 4/2015 | Ben David | E04B 1/388 52/468 |
| 9,127,451 | B1 * | 9/2015 | Boor | E04D 3/362 |
| 9,926,699 | B2 * | 3/2018 | Ben David | E04F 13/18 |
| 2023/0366206 | A1 * | 11/2023 | Ben David | E04D 3/366 |

FOREIGN PATENT DOCUMENTS

| | | | |
|---|---|---|---|
| EP | 3290613 | B1 | 1/2021 |
| ES | 1057820 | U | 10/2004 |
| ES | 1068311 | U | 10/2008 |
| WO | WO 2020/039423 | A1 | 2/2020 |

OTHER PUBLICATIONS

European Patent Office, Written Opinion in International Patent Application No. PCT/IL2021/051374, 8 pp. (Feb. 3, 2022).

* cited by examiner

POLYCARBONATE ROOF PANEL HAVING REINFORCEMENT RECESS FOR COUPLING TO SANDWICH PANEL

CROSS-REFERENCE TO RELATED APPLICATIONS

The instant application claims priority to International Patent Application No. PCT/IL2021/051374, filed on Nov. 17, 2021, and to Israeli Patent Application No. 280461, filed Jan. 27, 2021, each of which is incorporated herein in its entirety by reference.

FIELD OF THE DISCLOSURE

The present disclosure generally relates to polycarbonate roofs panels adapted for interconnection with so-called sandwich-type panels having outer metal skins.

BACKGROUND OF THE INVENTION

Sandwich-type panels formed by a structure consisting of two sheet metal skins and a filler material are commonly used as roof and wall coverings. Each panel has at opposite ends joints of complementary geometries thus allowing multiple panels to be coupled end to end and fixed to the building structure using screws, which may be visible or concealed. The metal skins are of course opaque so that such a structure is used where light transmission is not an issue.

Also known are light-transmissive polycarbonate panels that are coupled to sandwich-type panels for use on roofs and walls of industrial buildings in general, whereby light can enter the building, while protecting the roof from inclement weather and providing a degree of insulation to the upper part of the building.

EP 3 290 613 discloses a modular polycarbonate panel for roofs of buildings, comprising a cell structure defining a plurality of chambers, such that a first side has at least one tab defining a cavity that is suitable for being coupled to a second panel. A second side of the panel is suitable for being coupled to a third panel and has a projection defining a geometry complementary to the cavity defined by the tab of the first side. The modular panel can be coupled to successive adjacent panels for covering a surface of a roof or enclosure rapidly and safely while reducing the installation time.

The need to join polycarbonate panels and sandwich panels is particularly acute when used for roofing applications since the polycarbonate panels may be transparent or translucent to light while the sandwich panels are opaque. It is normal therefore to employ a modular construction wherein several sandwich panels are interconnected and at suitable intervals polycarbonate panels are interposed and must then be joined to the respective sandwich panels on either side.

BRIEF SUMMARY OF THE INVENTION

The present disclosure describes a coupling arrangement, which is configured for use with a panel and a panel system having the features of the preferred embodiments described hereinbelow.

In one aspect, the present disclosure describes an industrial roof panel includes a projection and a complementary wing at opposite sides. The projection has a recess configured for clamping the panel to a second neighboring panel using a fastener such that the panel is supported by the second neighboring panel for reduced buckling under downward load.

In another aspect, the present disclosure describes a modular panel system that includes first and second mutually juxtaposed panels, each supported by purlins of a building structure extending along a width of the panels. The second panel has an undercut extending along a length of the panel on a distal side thereof. The first panel has an integral wing-type female coupler extending along a length of the first panel and overlaying an upward projection of the second panel, to which it is secured using fasteners and bolts.

BRIEF DESCRIPTION OF THE SEVERAL VIEWS OF THE DRAWING(S)

FIG. 1 shows pictorially a known polycarbonate roof panel adapted for coupling to sandwich type panels.

FIGS. 2*a* and 2*b* show pictorially another known polycarbonate roof panel coupled to a sandwich type panel using a coupling assembly.

Figure 5:
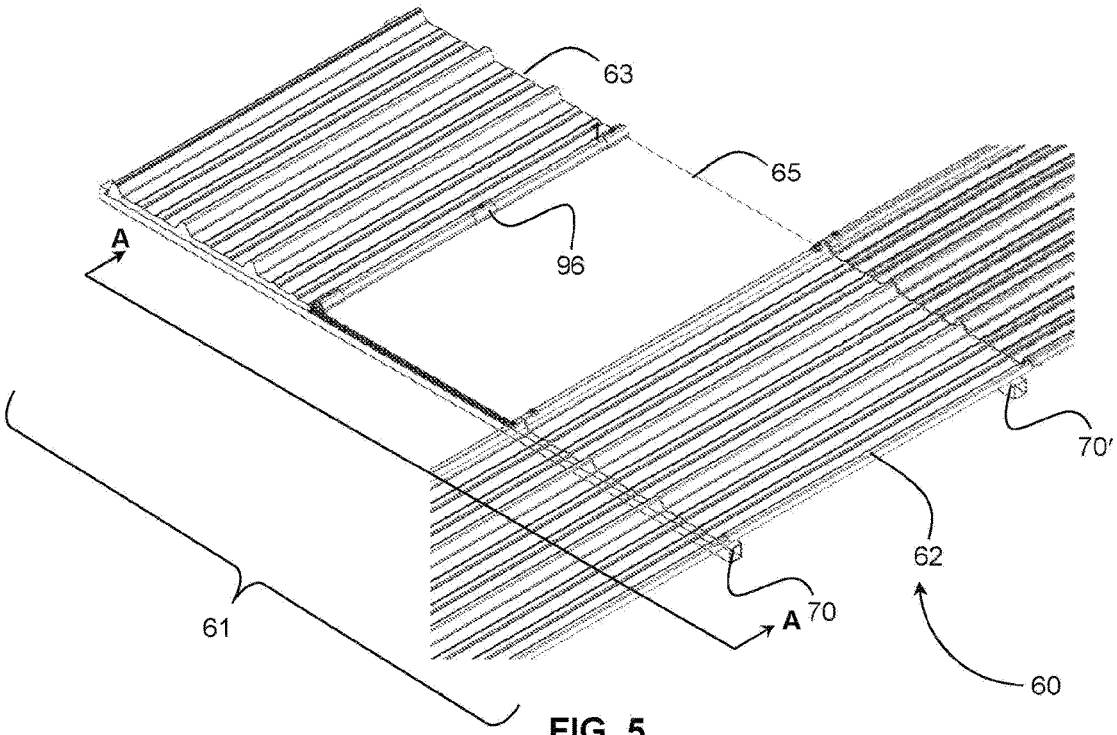
FIG. 5 is a perspective view showing part of a modular panel system in accordance with the present disclosure.
Figure 6A:
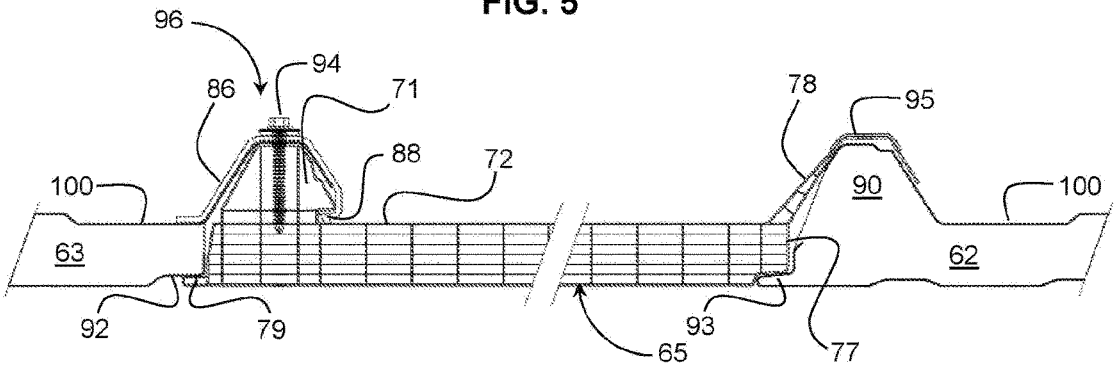
Figure 6B:
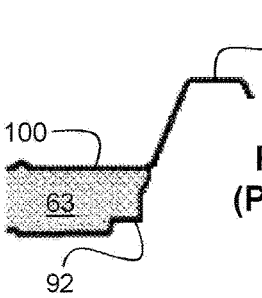
FIG. 6b (Prior Art)

FIG. 6*a* is a sectional view in the direction A-A of FIG. 5 between adjacent purlins;

FIG. 6*b* shows an enlarged detail part of a conventional sandwich panel having a metal wing fastener along its length.

Figure 6C:
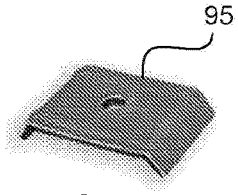
FIG. 6c (Prior Art)

FIG. 6*c* shows pictorially a conventional saddle washer that may be used to reinforce joints between adjacent panels.

Figure 7:
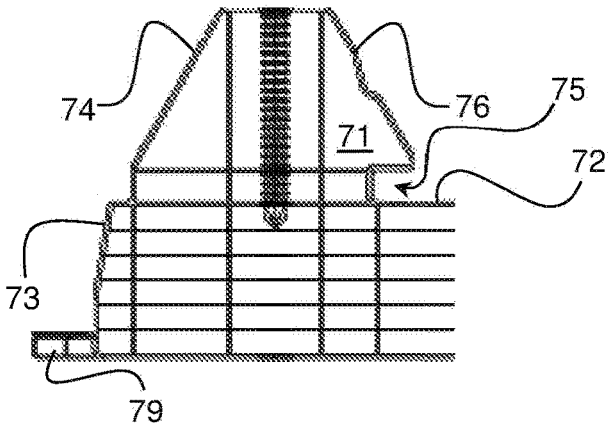
Figure 8:
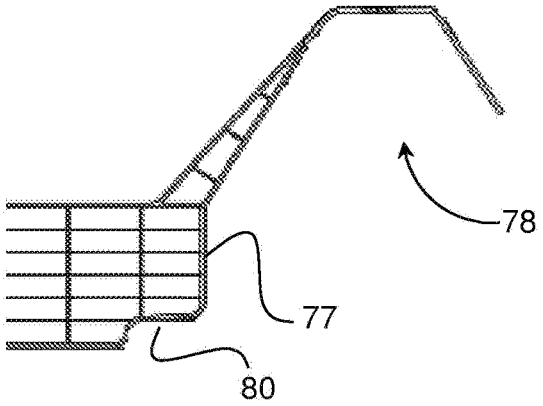

FIGS. 7 and 8 are enlarged details of an extruded projection and a female connector along a length of an intermediate polycarbonate panel used for securing it to an adjacent sandwich panel in accordance with the disclosure.

Figure 9:
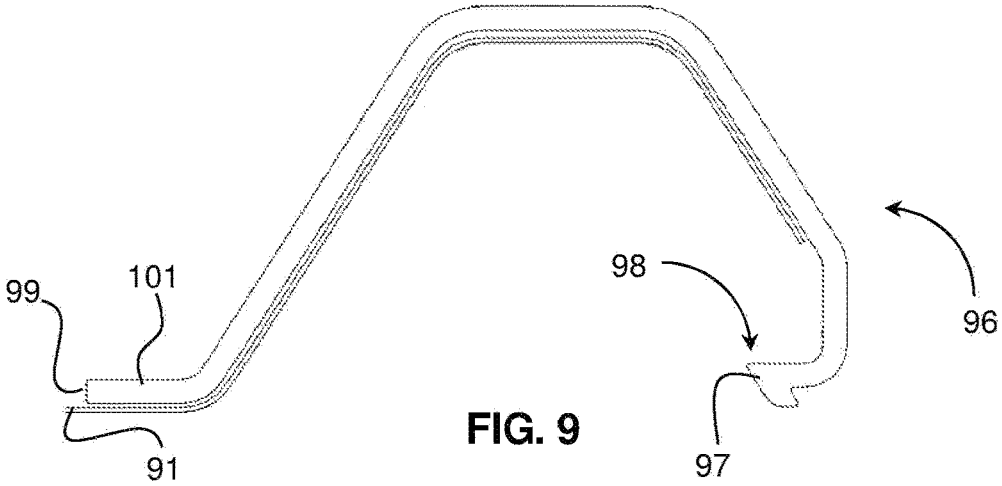

FIG. 9 is an enlarged detail of a coupling element in accordance with the disclosure.

Figure 10:
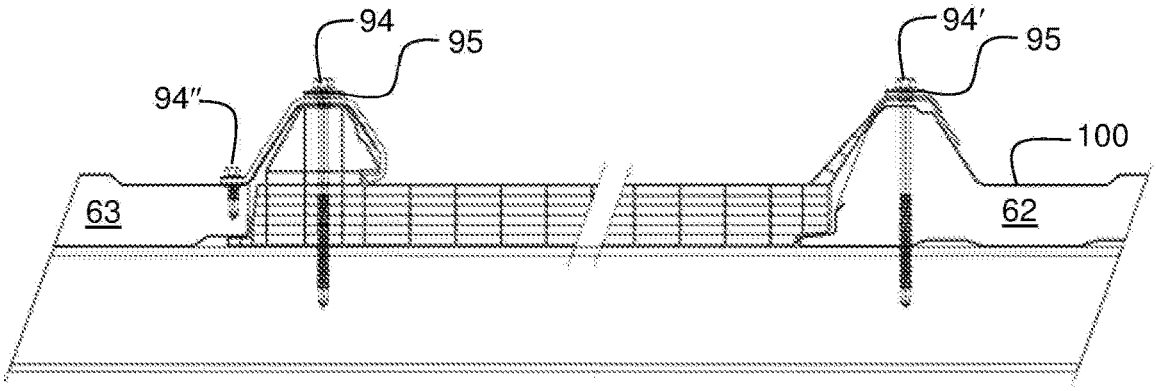

FIG. 10 is a sectional view in the direction A-A of FIG. 5 along a purlin showing screws securing the panels to the purlins in accordance with the disclosure.

DETAILED DESCRIPTION OF THE INVENTION

Figure 1:
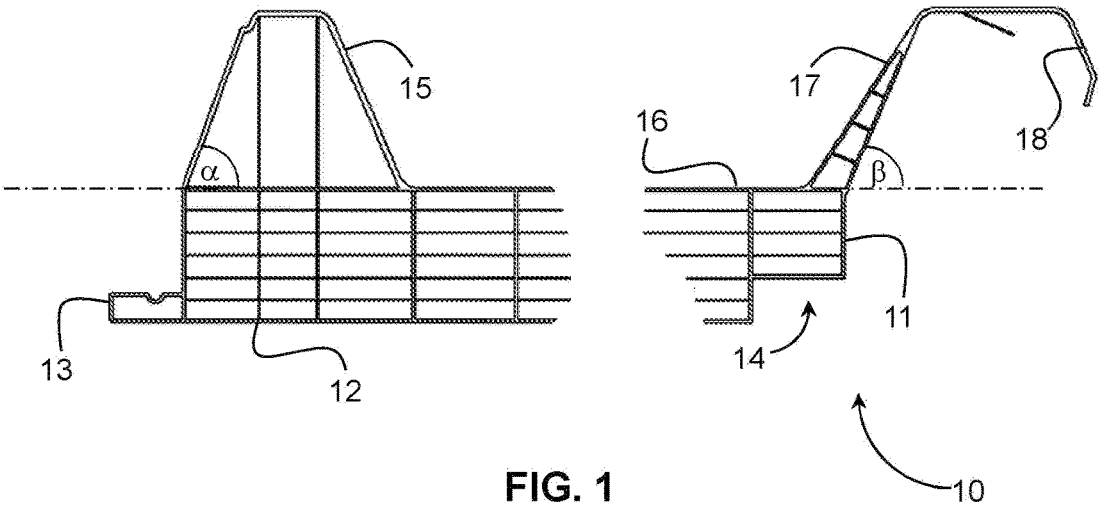
FIG. 1 (Prior Art)

FIG. 1 shows a prior art polycarbonate panel 10 corresponding to the teachings of EP 3 290 613 configured for coupling at opposite ends to respective sandwich-type panels (not shown). The polycarbonate panel 10 has a cellular body portion 11, a base 12 of which has an outwardly projecting flange 13 on one end and a depression 14 at the opposite end. A projection 15 of generally trapezoidal shape projects upwardly from an upper surface 16 of one end of the panel. The opposite end of the panel supports a jib arm 17 an upper end of which supports a polyhedral tab 18 whose shape may be complementary to that of the projection 15, and such that the respective base angles $\alpha$ and $\beta$ of the projection 15 and jib arm 17 are substantially identical. This allows multiple panels to be joined end to end, the projection 15 constituting a male connection and the shaped tab 18 constituting a female connector of complementary shape.

Figure 2A:
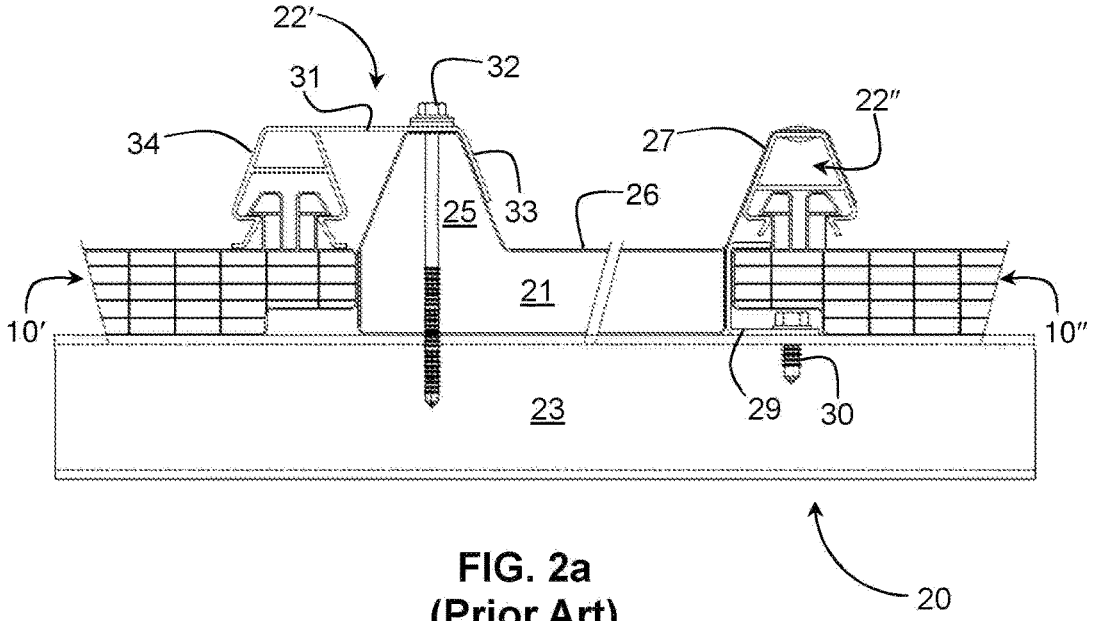
FIG. 2a (Prior Art)
Figure 2B:
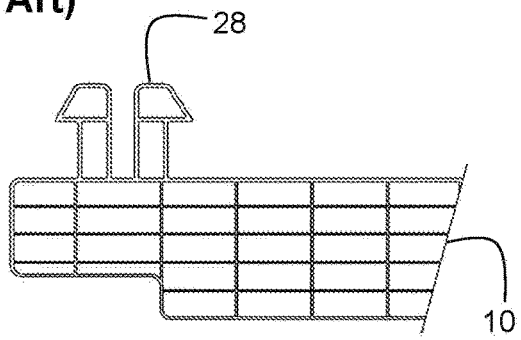
FIG. 2b (Prior Art)

FIG. 2*a* shows a detail of a modular panel system 20 wherein a chain of series-connected sandwich panels 21 are coupled at opposite ends of the chain to respective first and second polycarbonate panels 10', 10" by respective first and second coupling members 22', 22". Each sandwich panel 21 is fixedly attached to a building structure 23 and has a projection 25 (constituting a male connector) projecting upwardly from an upper surface 26 of the panel toward a first end and a tab 27 (constituting a female connector) of complementary shape projecting upwardly at its opposite second end. The tab 27 is shown schematically projecting upwardly from an edge of the panel bounding the upper surface 26 and the second end of the panel. The tab 27 extends outwardly away from the upper surface so as overlap the adjacent polycarbonate panel. Each of the polycarbonate panels 10', 10" has at least one joining flange 28 as shown in FIG. 2*b* toward each end projecting upwardly from the upper surface of the panel. A U-shaped support 29 is secured to the building structure 23 by a screw 30 and serves to support an end of the respective polycarbonate panel, while allowing it to thermally expand or contract relative to the sandwich panel 21.

The first coupling member 22' has a planar support member 31 adapted for attachment to the upward projection 25 of the sandwich panel 21. Conveniently this is achieved by means of the same screw 32 that fixes the sandwich panel to the building structure. The support member 31 may be bent to provide a side portion 33 that fits the outer contour of the projection 25 thereby impeding water leakage and rotation of the first coupling member 22'. Projecting downwardly from the support member 31 is a socket 34 adapted for coupling to the upwardly projecting flange 28 of the first polycarbonate panel 10'. A similar arrangement is provided for fastening the tab 27 to the upwardly projecting flange 28 of the second polycarbonate panel 10".

Figure 3:
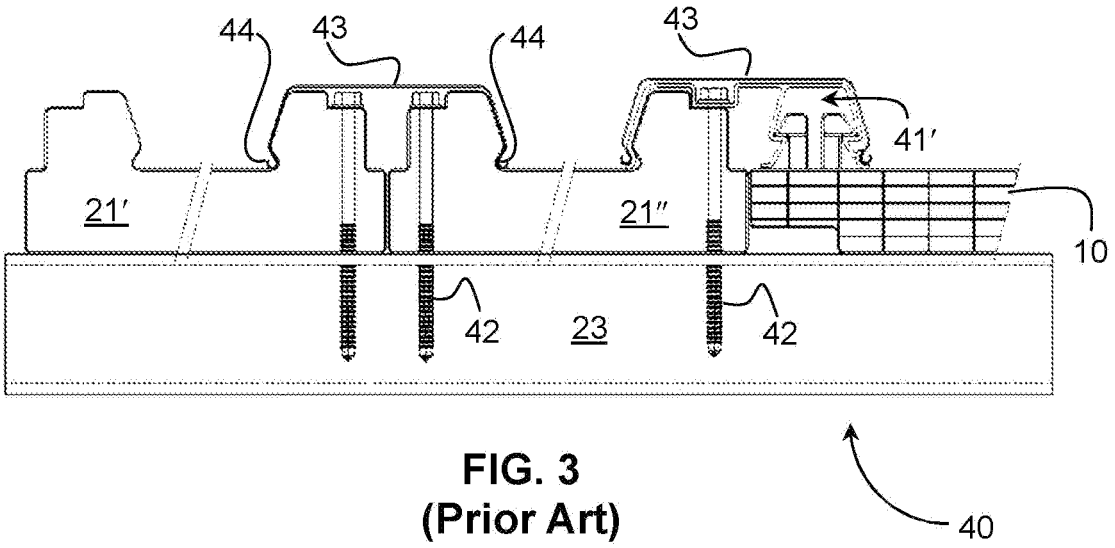
FIG. 3 (Prior Art)
FIG. 3 shows pictorially the same polycarbonate roof panel of FIG. 2 coupled to a serial connection of sandwich panels such that all joints have an identical profile.

FIG. 3 shows a modular panel system 40 comprising a pair of juxtaposed sandwich type panels 21', 21" one of which is coupled to a polycarbonate roof panel 10 by a coupling member 41' configured that when fixed to the sandwich panel 21" it forms an outer contour that is identical to that of the two juxtaposed sandwich panels. Each of the sandwich panels 21' and 21" is independently affixed to the structure 23 by respective screws 42, and the seam between the two sandwich panels is covered by a cap 43 that prevents water leakage. Likewise, where the sandwich panel 21" abuts the polycarbonate panel 10 a cap 43 is mounted over the joint so that when viewed from above all the seams appear identical. The caps 43 are snap-fitted on to the upward projection of the sandwich panels and to the upwardly projecting flange of the polycarbonate panel 10 to engage indents 44 formed at the base of the respective projection or flange.

Figure 4:
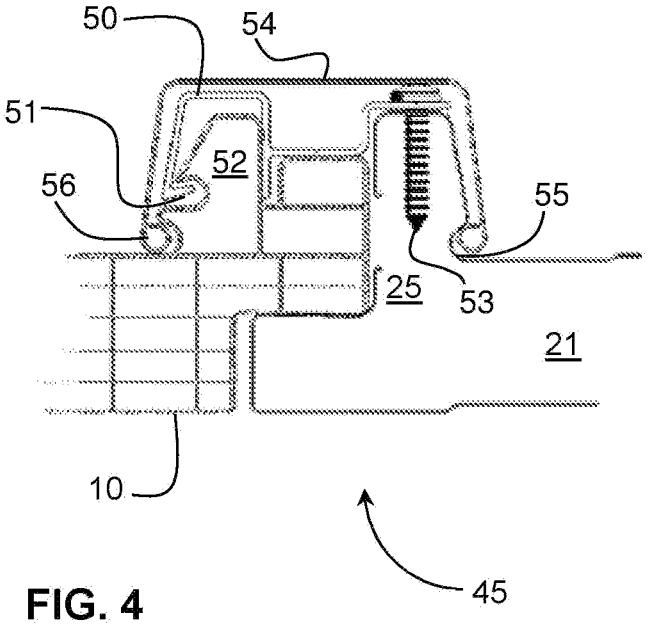
FIG. 4 (Prior Art)
FIG. 4 shows pictorially another prior art polycarbonate roof panel coupled to a sandwich panel and having a clip-on cap for sealing against rain.

FIG. 4 shows pictorially part of a panel system 45 wherein a juxtaposed polycarbonate panel 10 and sandwich panel 21 are joined using a coupling assembly 50 formed of metal and shaped to engage an indent 51 in an upwardly projecting flange 52 of the polycarbonate panel 10 and fastened to the upward projection 25 of the sandwich panel 10 by a screw 53. The coupling assembly 50 clamps the polycarbonate panel 10 to the sandwich panel 21 and supports it against downward force applied to the polycarbonate panel 10 near the joint. The resulting joint between each pair of juxtaposed panels be they sandwich-sandwich or sandwich-polycarbonate is covered by a sealing cap 54. To this end, indents 55 are formed at the base of the respective projection or flange and serve to engage corresponding shaped lips 56 at the lower rims of the caps 54, thus allowing the caps to be snap-fitted to each of the adjacent panels.

It emerges from the foregoing description that polycarbonate panels are known having upwardly projecting flanges that have an indent such as shown in FIG. 4 shaped for accommodating a rigid metal coupling element that is screwed to an adjacent sandwich panel. In this case, the indent 51 is not formed at the base of the flange; nor can it be since there is formed another indent 55 at its base for engaging the lips 56 of the cap 54. The indents 55 are configured to accommodate these lips in a snap-fit engagement: they provide no structural support for the coupling element.

Likewise, there are known polycarbonate panels as shown in FIG. 1 having at opposite ends an upwardly projecting trapezoidal flange and a tab or wing coupling element. These are commonly used in the industry to connect to sandwich type panels in roof structures supporting a plurality of juxtaposed opaque sandwich type panels with interposed skylights formed of polycarbonate panels.

Furthermore, in all the panel arrangements described above, to the extent that they provide support for the ends of the polycarbonate panels where they abut an adjacent sandwich panel, the coupling elements are designed to provide this support. This is true for the arrangements of FIGS. 2, 3 and 4. But while the polycarbonate panel of FIG. 1 is well supported by the polyhedral tab 18 on the upward projection of an adjacent sandwich panel, which is sufficiently rigid to provide good support, it is vulnerable at its opposite end where its upward projection 15 merely provides a seating for the wing-type coupling element of an adjacent sandwich panel but is in no way supported by the sandwich panel. It is to this vulnerability that the present invention is directed.

FIG. 5 shows a perspective view of part of a roof panel structure. Sandwich panels are laid lengthwise along purlins of which two are shown spanning the width of the roof structure with an intermediate gap. The sandwich panels are, of course, opaque and in order to admit light through the roof structure, transparent or translucent polycarbonate panels are laid across the gaps. The purlins extend along the full widths of the extruded panels, which can be several meters in length and extend in both directions perpendicular to the purlins. The purlins are spaced apart at sufficiently close intervals whereby the sandwich panels are rigidly supported between opposing purlins, such that a person such as a construction worker can stand on the sandwich panels without them buckling. However, the polycarbonate panels will buckle under a person's weight and therefore require additional support to prevent this, as well as to withstand environmental and climatic loads such as snow and wind.

Prior art coupling arrangements are known that prevent or reduce buckling owing to the different rates of thermal expansion of sandwich panels and polycarbonate panels. For example, WO 2020/039423 (corresponding to IL 261363) discloses a modular panel system that includes adjacent polycarbonate and sandwich type panels, the polycarbonate panels being fixed to a building structure. Various types of coupling members are described that are attachable to both panels in such manner as to withstand forces applied to either surface of the panel system while allowing the panels to thermally expand along their common seams at different rates.

However, there is a need for a coupling arrangement for panels of a geometry similar to the panel disclosed in EP 3 290 613 as shown in FIG. 1, commonly referred to as a European-Type panel system, having a generally trapezoidal upward projection at one end, wherein the coupling arrangement offers built-in reinforcement along the seam between adjacent panels adjacent the trapezoidal projection so that the resulting roof structure will better withstand a person's weight without buckling.

Further, and more generally, there is a need, in the European-Type panel system, as described in EP 3 290 613 to couple the joint between two adjacent panels such that both panels will simultaneously support a downward force exerted on each of the panels alone or on both together.

This need exists also when both panels are sandwich-type panels with the same rigidity, so that when coupled, the load will be spread over a larger area, such that the panels will buckle together, to a lesser extent, and no gap will be opened between them.

In the following description of some embodiments, identical components that appear in more than one figure or that share similar functionality will be referenced by identical reference symbols.

Referring to FIGS. 5 to 10 there are shown details of a modular panel system 60, comprising at least one triad 61 of mutually juxtaposed panels, of which two outer panels 62, 63 have a high rigidity relative to a third intermediate panel 65. Typically, the outer panels 62, 63 are sandwich-type panels consisting of two sheet metal skins and a filler material. Owing to the outer metal skins these panels are opaque and, in order to transmit ambient light, the intermediate panel is formed of light-transmissive polycarbonate and is mounted edge to edge between the two outer panels.

The panels are supported on a roof structure comprising purlins 70, 70' that extend along a width of the panels. The panels are typically extruded and are laid lengthwise across the purlins, which are spaced apart at intervals that provide sufficient rigidity to the sandwich-type panels to allow a person to stand on them without causing damage or buckling. In FIG. 5 one of the sandwich panels 62 is elongated in both directions to show more clearly that the drawing shows only that portion of the panels supported between adjacent purlins. It also serves to distinguish between the width of the panels along the length of the purlin and the length of the panels which extend across multiple purlins.

As shown in FIGS. 6*a*, 7 and 8, the polycarbonate panel 65 has a trapezoidal projection 71 projecting upwardly from an upper surface 72 of the panel and extending along a length of the panel toward a first side thereof 73 constituting a proximal side 74 of the projection 71. The projection 71 has an undercut 75 defining an internal recess extending along a length of the panel on a distal side 76 of the projection. Although in the figures the undercut 75 forms an overhang with the upper surface of the panel such that the recess is located between the overhang and the panel surface, the recess may be formed in the side wall of the projection at a higher location than the panel surface. At a second side 77 of the polycarbonate panel 65 and extending along its length, there is provided a wing-type female connector 78 projecting upwardly from an edge of the panel bounding the upper surface 72 of the panel 65 and extending outwardly away from the upper surface. It is to be noted that the female connector 78 is similar in form and function to what is described in above-mentioned EP 3 290 613.

The polycarbonate panel 65 has an outwardly projecting flange 79 and a depression 80 each extending along a length of the panel at a lower surface thereof on the first side 73 and the second side 77 of the panel, respectively. It will be appreciated that FIG. 6*a* shows only the coupling of each side of the polycarbonate panel 65 to respective sandwich panels. In practice on both sides of the polycarbonate panel there are multiple sandwich panels whose interconnection is conventional and not a feature of the present invention. Likewise, the manner of coupling the polycarbonate panel 65 at its second side 77 to the sandwich panel 62 is conventional. The novelty of the invention thus resides only in the modification of the first side 73 of the polycarbonate panel 65 that allows it to be coupled to existing sandwich panels while providing greater rigidity.

All of the sandwich panels 62, 63 are identical and have at one end a trapezoidal projection 90 and at the opposite end a wing-type coupling element 91 (FIG. 6*b*) of complementary shape both of which extend along the full length of the panel. Multiple sandwich panels can therefore be juxtaposed with the wing-type coupling element 91 of one panel overlaying the trapezoidal projection 90 of an adjacent panel, the two then being secured to the purlins by screws that pass through both the wing-type coupling element and the trapezoidal projection of the two adjacent panels. Optionally, each of the sandwich panels 62, 63 may also have a depression 92 and an outwardly projecting flange 93 each extending along a length of the panel at a lower surface thereof for engaging the complementary flange 79 and depression 80 on the first side 73 and the second side 77 of the polycarbonate panel 65, respectively.

Conventional coupling of the sandwich panel 63 to the polycarbonate panel 65 at its first side 73 requires only that the wing-type coupling element 91 of the sandwich panel be mounted over the trapezoidal projection 90 of the adjacent polycarbonate panel 65 after which sufficiently long self-tapping screws 94 shown in FIG. 10 are used to screw the resulting assembly to the purlins below. The joint is reinforced by interposing between the screw 94 and the wing-type coupling element 91 a saddle washer 95, such as shown in enlarged detail in FIG. 6*c* and sold, for example, under the name Baltic Fasteners®, which is a trademark of Eurofast. The saddle washer 95 has a generally trapezoidal aluminum profile lined with a foam layer, which adapts to the outer contour of the wing-type coupling element 91 and prevents leakage. The result is that while the second side 77 of the polycarbonate panel 65 is uniformly supported by the flange 93 and projection 90 of the sandwich panel 62, this is not the case at the first side 73 of the polycarbonate panel 65, where the polycarbonate panel is vertically supported only at the purlins and a worker standing on the polycarbonate panel 65 towards its first side 73 between purlins will cause the polycarbonate panel 65 to deform if not even break under the weight. The same might also occur under the weight of heavy snow.

The present invention allows the joint at the first side 73 to be reinforced between purlins by clamping wing-type fasteners 96 over the wing-type female coupling element 91. The fastener 96 may be formed of sheet material such as aluminum, of generally complementary shape to the projection 71 of the intermediate panel 65 and having a hook shaped lip 97 along a distal edge 98 of the fastener. The wing-type female coupling element 91 is shown in enlarged detail in FIG. 6*b*. As shown in FIG. 6*a*, showing a sectional view between adjacent purlins, the wing-type female coupling element 91 fits over the projection 71 of the polycarbonate panel 65 and is secured thereto using the fasteners 96 as described in further detail below. The wing-type female coupling element 91 provides a waterproof seal between the adjacent panels regardless of whether they are sandwich-sandwich or sandwich-polycarbonate. To this end, it will be appreciated that the trapezoidal projections 71 and 90 of the polycarbonate and sandwich panels 65 and 62, respectively, have similar if not identical contours. Optionally, wing-type fasteners 96 may also be clamped over the wing-type female coupling element 91 at the purlins using long screws that penetrate all the way through to the purlins. However, as noted above, the panels are in any case supported at the purlins, so such reinforcement is not essential.

FIG. 9 is an enlarged detail of the coupling element 96 also showing part of the underlying wing-type female coupling element 91, which projects from the sandwich panels in known manner.

The depression 80 of the polycarbonate panel 65 accommodates the flange 93 of the adjacent sandwich panel 62 and the flange 79 of the polycarbonate panel 65 is accommodated within the depression 92 of the adjacent sandwich panel 63. As best seen in FIGS. 5 and 6*a*, at least one fastener 96 is affixed at its proximal edge 99 to the upper surface 100 of the panel 63 at a location intermediate the purlins 70, 70' and is resiliently mounted over the wing-type female coupling element 91 and the trapezoidal projection 71 of the polycarbonate panel 65 so that its hook shaped lip 97 engages the undercut 75 of the projection 71. As shown in FIGS. 6*a* and 10 each of the fasteners 96 is secured to the projection 71 of the polycarbonate panel by respective screws 94 and may also be secured to the sandwich panel 63 by a screw 94" passing through a proximal surface 101 of the fastener (see FIG. 9) into the sandwich panel 63. Optionally, fasteners 96 may be similarly affixed at their respective proximal edges 99 to the upper surface 100 of the outer panel 63 at locations along its length coincident with respective spaced apart purlins 70, 70' as shown in FIG. 10. However, this will not be necessary if saddle washers are employed as described above. Likewise, the female connector of the polycarbonate panel 65 accommodates the second projection 90 of an adjacent sandwich panel and is secured thereto by respective screws 94', typically on top of a saddle washer 95. Preferably, where the fasteners 96 are located directly above the purlins 70, 70', the screws 94, are sufficiently long to penetrate the respective purlins 70, 70' thus allowing the panels to be secured to each other as well as to the building structure with the same screws. In contrast, the screws securing the additional fastener or fasteners located intermediate the purlins 70, 70' are short so that they do not completely penetrate through the intermediate polycarbonate panel 65, since they would then be visible.

Depending on the rigidity of the fastener 96, it may either be slid from the side into the undercut 75 and then moved along to where it is anchored to the underlying purlin or to a desired location intermediate the purlins; or, and preferably, it may be snap-fitted on to the wing-type coupling element 91 and the underlying trapezoidal projection 71 simply by pressing down whereby the hook shaped lip 97 splays apart slightly and then springs back into the undercut 75. In either case, the fastener 96 must be sufficiently rigid that when clamped to the trapezoidal projection 71, it supports the polycarbonate panel 65. To this end, the wing-type female coupling element 91 of the sandwich panel supports the fastener 96 as seen in FIG. 9 since the sandwich panel is rigidly supported on the underlying purlins. Therefore, since the fastener 96 is mounted on top of the wing-type female coupling element 91 it, too, is supported against any tendency to sink owing to force applied to the polycarbonate panel near the trapezoidal projection 71. So, in effect, the fastener 96 serves as a fixed anchor in space that supports the hook shaped lip 97, whose upper surface rigidly engages the exposed edge of the trapezoidal projection 71 within the undercut 75. Consequently, the polycarbonate panel 65 is retained by the fastener 96 even when force is applied vertically close to the seam between adjacent panels.

During construction of a roof using these panels, the first sandwich panel 62 is laid across the purlins as shown in FIG. 5. The polycarbonate panel 65 may then be laid across the purlins with its depression 80 overlaying the flange 93 of the already laid sandwich panel 62 and with its wing-type female connector 78 over the trapezoidal projection 90 of the panel 62. Screws 94' are then employed to secure the two panels, preferably on top of the saddle washers 95. The second sandwich panel 63 may then be laid across the purlins so that its depression 92 overlays the flange 79 of the polycarbonate panel 65. The respective hook shaped lip 97 of each of the fasteners 96 is then clicked (or slid) into engagement with the undercut 75 and moved if necessary to its desired location along the length of the panel relative to the adjacent purlins. It is secured by the screws 94, 94". The act of securing the fasteners 96 results in its proximal surface 101 resting flush on the upper surface 100 of the sandwich panel 63. A screw 94" may then be used to secure the proximal surface 101 of the fastener to the panel 63.

Although the invention has been described with reference to both ends of the panel structure, in fact the coupling of the second side 77 of the polycarbonate panel to the adjacent first sandwich panel 62 is known per se from EP 3 290 613. The invention resides in the manner of reinforcing the coupling of the first side 73 of the polycarbonate panel to the adjacent second sandwich panel 63 and in a novel polycarbonate panel having an undercut and a fastener that cooperate to facilitate the required reinforcement.

However, although the benefit of the invention is particularly pronounced for polycarbonate panels whose rigidity is lower than sandwich panels, it is to be noted that the same principle may also be applied to sandwich panels, which are provided with similar projections that may be advantageously provided with an undercut recess and whose interconnection may be reinforced using fasteners in like manner. Further, the undercut recess may be also situated in the proximal side of the projection rather than in the distal. And further, the undercut recesses may be formed at desired discrete locations along the projection, rather than being continuous.

In this connection if we consider the seam between the two panels 62 and 65 shown in FIG. 6*a*, it will be appreciated that regardless of the material from which they are formed and whether they are formed of the same or different materials, the panel 65 is supported toward its second (i.e. right) side at both its upper and lower surfaces by the lower flange 93 and the trapezoidal projection 90 of the panel 62. Consequently, a downward force applied to the panel 65 near the seam between two adjacent panels will be restrained by the flange 93 and the connection between the trapezoidal projection 90 and the wing-type female connector 78. However, a downward force applied to the panel 62 at its left side will not be supported by the panel 65. Therefore, it may be beneficial to provide an undercut recess such as 75 also to the trapezoidal projection 90 of the panel 62 so as to facilitate reinforcement also of the joint between the panels 65, 62, using fasteners such as 96. In such case, there will be provided a roof structure comprising a European-Type panel system, all of whose panels have an undercut recess in their trapezoidal projections and all of whose joints are reinforced using fasteners such as 96.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular panel system, comprising:

at least first and second mutually juxtaposed panels, each of said panels being supported by spaced apart purlins of a building structure that extend along a width of the panels, the second panel having a projection projecting upwardly from an upper surface of the panel and extending along a length of the panel at a first side of the panel constituting a proximal side of the projection, said projection having on a distal side an undercut defining an internal recess extending along a length of the panel, said undercut having a lower surface flush with an upper surface of the panel, the first panel having an integral wing-type female coupler of complementary shape to the projection, said female coupler extending along a length of the first panel and overlaying the projection of the second panel, and fasteners of similar shape to the wing-type female coupler for overlaying the wing-type female coupler, each fastener having a hook shaped lip along an edge thereof for engaging the undercut of the projection and being fixedly attached using a bolt that extends through the fastener, the wing-type female coupler and the projection, whereby the second panel is supported between the wing-type female coupler of the first panel and the hook shaped lip.

2. The modular panel system according to claim 1, wherein at least two of said fasteners are affixed to the first panel where it overlays respective adjacent purlins.

3. The modular panel system according to claim 1, wherein at least one of said fasteners is affixed to the first panel at a location intermediate adjacent purlins.

4. The modular panel system according to claim 1, wherein for each panel at least two of the fasteners are located in line with respective purlins and are secured to the projection of the second panel by respective screws that are sufficiently long to penetrate the respective purlins.

5. The modular panel system according to claim 1, wherein the second panel has an outwardly projecting flange extending along a length of the second panel at a lower surface thereof on a side of the panel for engaging a complementary depression extending along a length of an adjacent first panel at a lower surface thereof.

6. The modular panel system according to claim 1, wherein the first panel is a sandwich-type structure consisting of two sheet metal skins and a filler material.

7. The modular panel system according to claim 1, wherein the second panel is formed of polycarbonate.

8. The modular panel system according to claim 1, wherein the second panel is light-transmissive.

9. The modular panel system according to claim 1, wherein both the first and second panels are sandwich-type structures consisting of two sheet metal skins and a filler material.

10. The modular panel system according to claim 1, wherein the projections are trapezoidal in shape.

11. The modular panel system according to claim 1, wherein a proximal edge of the fastened is screwed to an upper surface of the first panel.

* * * * *